US006668780B1

(12) United States Patent
Svenningsson

(10) Patent No.: US 6,668,780 B1
(45) Date of Patent: Dec. 30, 2003

(54) DEVICE FOR ELECTRONIC IGNITION SYSTEMS

(76) Inventor: Rune Svenningsson, Box 184, S-332 24 Gislaved (SE)

( * ) Notice: Subject to any disclaimer, the term of this patent is extended or adjusted under 35 U.S.C. 154(b) by 0 days.

(21) Appl. No.: 10/222,596

(22) Filed: Aug. 15, 2002

(51) Int. Cl.[7] ..... F02P 1/00

(52) U.S. Cl. ..... 123/149 D; 123/149 A; 123/406.53

(58) Field of Search ..... 123/149 D, 149 A, 123/149 R, 149 F, 406.56

(56) References Cited

U.S. PATENT DOCUMENTS 3,465,739 A 9/1969 Burson et al. ..... 123/149
3,515,109 A 6/1970 Farr et al. ..... 123/148
3,629,632 A * 12/1971 Loupe ..... 310/74
3,886,916 A 6/1975 Henderson ..... 123/117 R
4,430,984 A * 2/1984 Tharman ..... 123/647
5,105,794 A * 4/1992 Fukuda ..... 123/651

* cited by examiner

*Primary Examiner*—Bibhu Mohanty
(74) *Attorney, Agent, or Firm*—Robert G. Lev

(57) ABSTRACT

The present invention relates to a device at an inductive sensor for achieving a displacement, dependent on the rotation speed, of the ignition preset in an electronic ignition system at combustion engines. The device comprises a coil (5), a magnet (3, 8), rotating in relationship to the coil, which magnet creates a ramplike voltage in the coil and a thin sheet (7) made from a magnetic material influencing the magnet field such that the moment of time for achieving a certain voltage in the coil (5) is displaced. The thin sheet (7) is mounted at the coil and extends from same into the magnet field. Hereby the think sheet extends perpendicularly to the central axis of the coil or forms an angle, deviating from 90 degrees from same.

5 Claims, 3 Drawing Sheets

FIG. 3
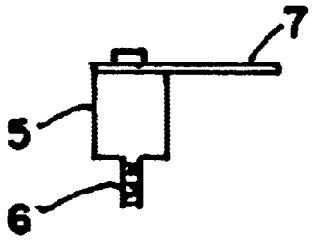
FIG. 4
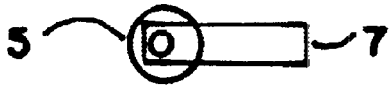
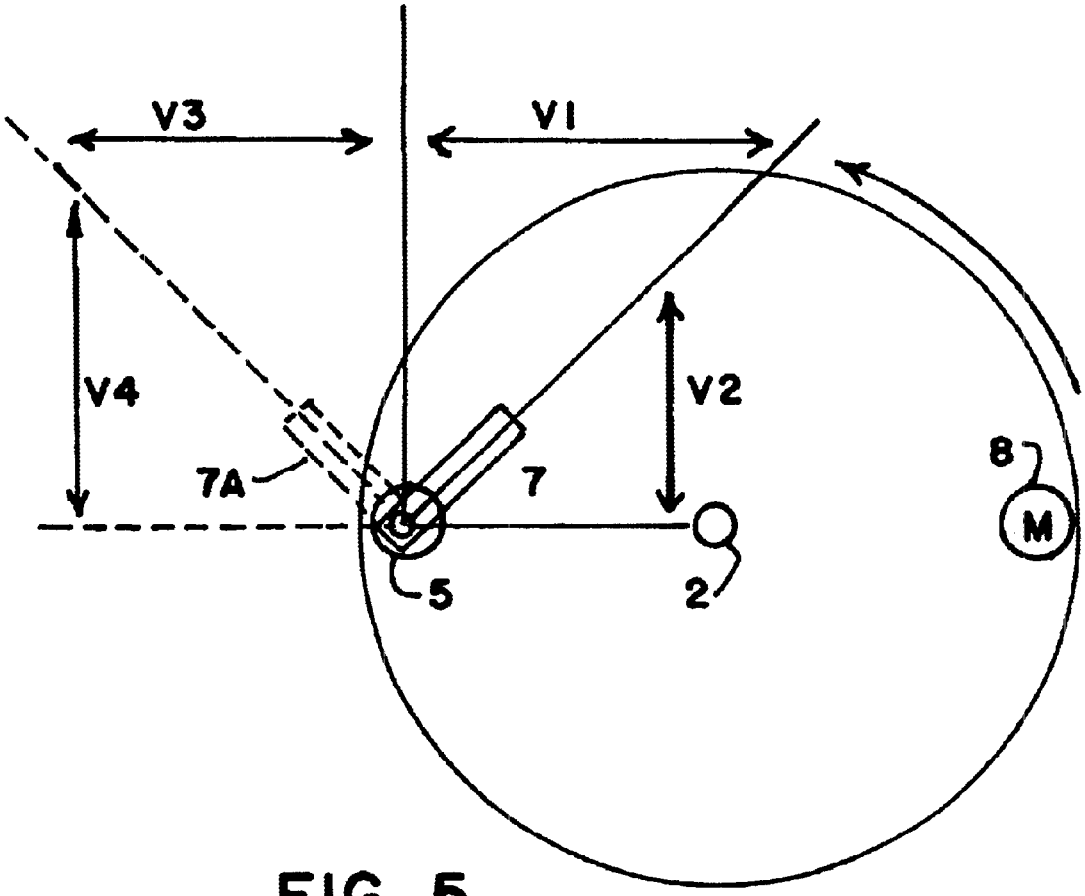
FIG. 5

DEVICE FOR ELECTRONIC IGNITION SYSTEMS

The present invention relates to a modification to an sensor in electronic ignition systems for combustion engines to adjust ignition timing.

In combustion engines, the mixture of fuel- and air, which is ignited by the aid of a spark, achieve their best effect and highest driving torque when the spark is provided at exactly the correct moment of time for each engine speed. Simple electronic ignition systems are not able to adjust the moment of ignition, when the spark is provided, to the changing demands of the motor. This means, that engine performance will be far below that which could be achieved. The object of the present invention is to create a device, that better facilitates adjustment of ignition timing to the working conditions of the motor, primarily to its engine speed.

A coil moving in a magnetic field produced an induced voltage, the characteristics of which is dependent upon the strength of the magnetic field, the inductance of the coil and the speed with which coil cuts the magnetic flow lines. If the magnetic field is produced by a permanent magnet, the strength of the magnetic field is constant at any given point. The inductance of the coil is determined by its design and is constant for any given coil. If these two features are constant, the speed of movement will be the factor, that will make the induces voltage across the coil vary. In a conventional magnetic ignition system for instance, the voltage is induced in a coil by acting upon the coil with a permanent magnet, mounted on the flywheel of the motor. The voltage obtained from the coil the trigger voltage; is dependent upon the engine speed.

As the design of the coil in any given device cannot he changed as a function of the working conditions, the action of the magnetic field will he the factor, that can be utilised to adjust the voltage induced in the coil and thus the moment of ignition.

FIGS. 3 and 4 show a coil with flux control sheet according to the invention.

FIG. 5 shows different set positions of the device according to the invention.

Figure 1:
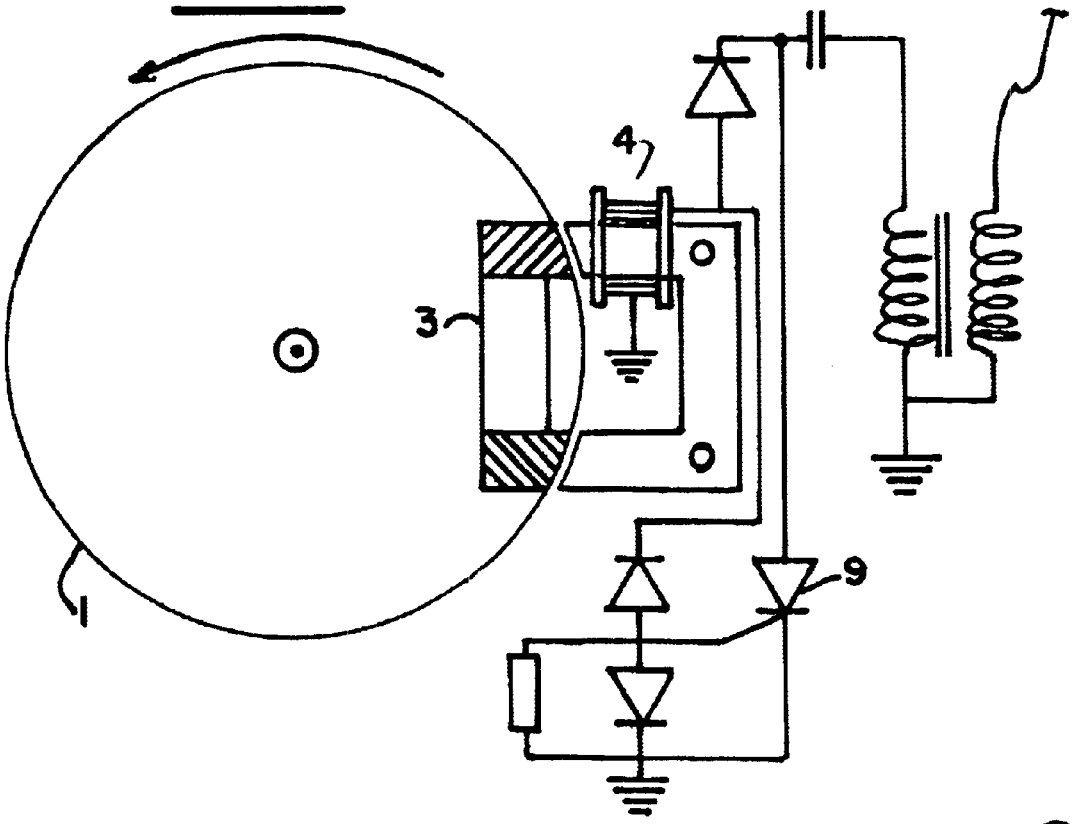
FIG. 1 shows a schedule of magnet ignition system according to known techniques.

FIG. 1 shows a magnet ignition system according to known techniques with self-trigging and a fixed moment of ignition A magnet 3 is fixed to the flywheel 1, and when this rotates a voltage is created in the ignition coil 4. The voltage gives, via a thryistor control 9, rise to an outgoing ignition charge.

Figure 2:
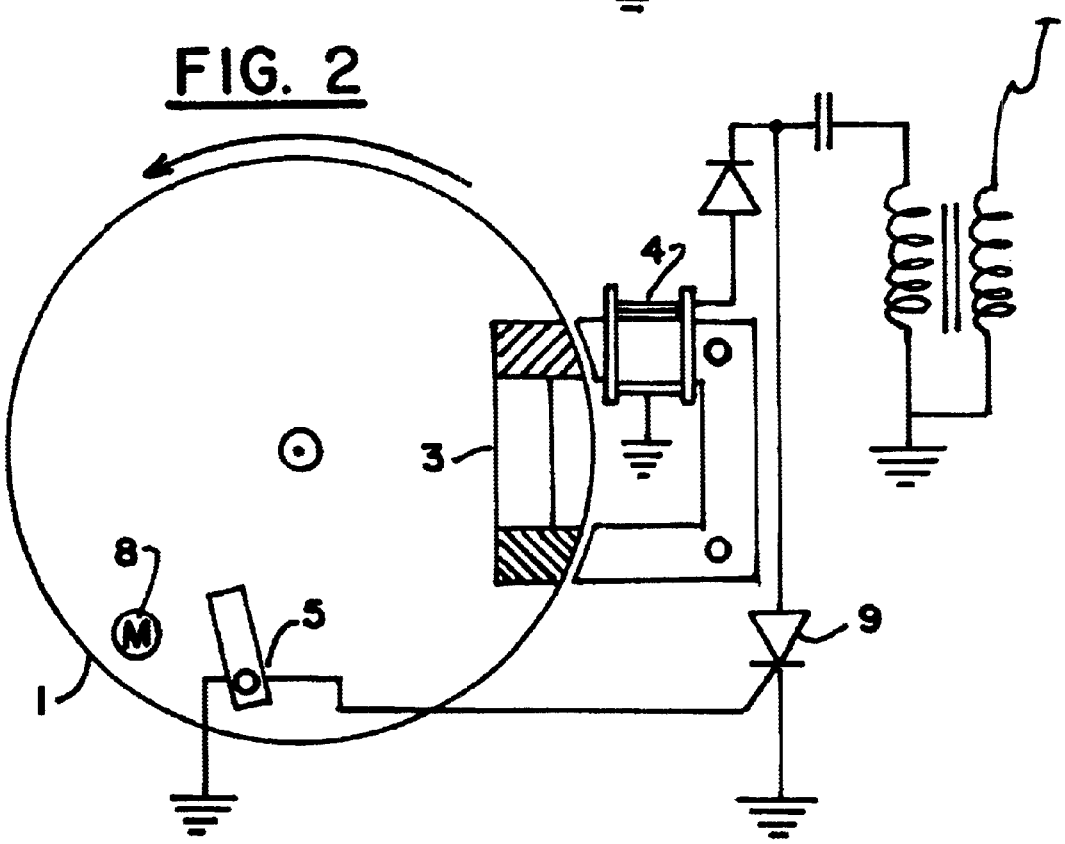
FIG. 2 shows a schedule of a magnet ignition system according to the invention.

A corresponding ignition device utilising the present invention, is shown in FIG 2. In this depiction certain portions of the electronic circuit have been removed and been replaced by a connection to a sensor coil 5, that is firmly fixed in the vicinity of the flywheel and in which a voltage is induced by the action of a magnet 8 mounted on the flywheel.

Figure 6:
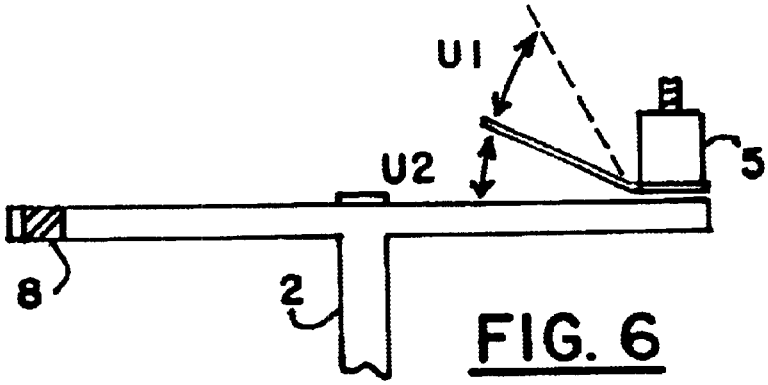
FIG. 6 shows a side view of an alternative embodiment of the invention.

The design and arrangement of the sensor coil 5 is shown in greater detail in FIGS. 3,4 and 6. The flywheel 1 is mounted at a crankshaft 2 and is rotated therefrom. The coil 5 is firmly in the vicinity and is acted upon by a rotating magnet 8, provided on or adjacent the flywheel at same. When the magnet rotating with the flywheel passes the sensor coil, there is induced a ramp formed voltage in sensor. The moment of time, at which the level of voltage attains a certain value, varies depending on the position of a thin sheet 7, influencing the magnetic field in the vicinity of the coil sensor 5. The thin sheet 7, named flux control sheet, varies in form and size dependent on the actual engine application. The thin sheet may be mounted at the sensor coil by a screw 6, that simultaneously forms an iron core for the coil and a fastening screw for the thin sheet and the coil. The thin sheet may also, achieving the same effect, be mounted adjacent the rotating magnet.

In FIG. 5 a different set possibilities are shown, with angles V1 and V2 for the thin sheet 7 in a first position or angles V3 and V4 for the thin sheet 7 in an alternative position. The extension of the thin sheet is parallel to the rotation plane of flywheel 1. Here the angles V1 and V3 respectively are the smallest angles, in relationship to a tangent in the direction of rotation, at which a desired influence is achieved. The angles V2 and V4 respectively, show an available field of work. In an alternative embodiment according to FIG. 6, the direction of the thin sheet deviates from the rotational plane of the flywheel 1 and the thin sheet extends inclined in relationship to this plane. The position of the thin sheet then may be varied, for instance within the angles V1 and V2 according to FIG. 6. Also in this case there is a least an angle V2 for achieving the desired result and a working field.

Figure 7:
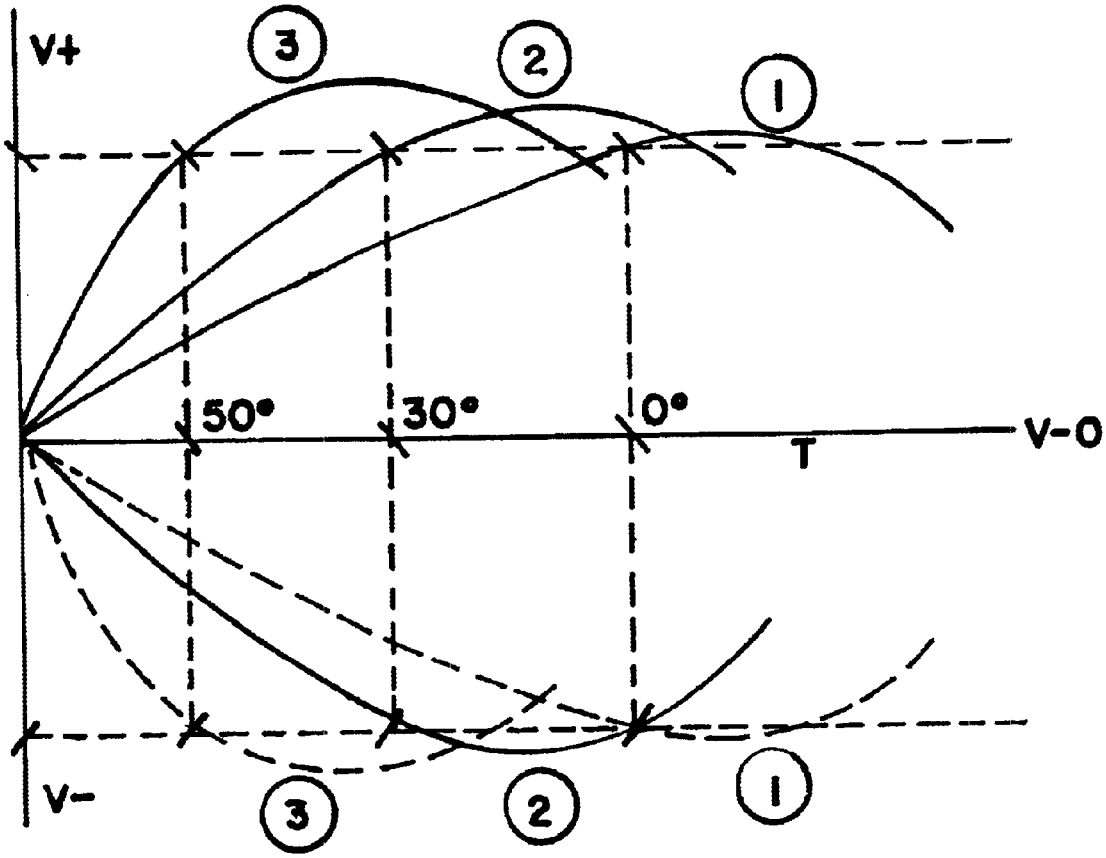
FIG. 7 shows the trigger voltage as a function of the ignition preset.

The diagram in FIG. 7 shows how the ignition timing varies due to different rotation speeds. In the diagram the trigger voltage V is shown as a function of the ignition timing. The ignition is initiated at the defined voltage level. The voltage may be described as a ramp function with the form shown by the curves 1,2 and 3 in the diagram FIG. 7, corresponding to different engine speeds. The variation of the inclination of the ramp voltage function is dependent on the varied movement of the magnetic field through the sensor coil 5 achieved by the varied engine speed.

The embodiment disclosed above shall by no means be regarded as limiting the invention. Within the scope of the invention embodiments of the invention may be varied in several ways. The magnet acting upon the sensor coil may be the same as that being utilised for obtaining the ignition voltage. The magnet may also be brought to rotate by other means than by being mounted at the flywheel, for instance its rotation may be obtained directly or indirectly by a camshaft. Also the size and design of the thin sheet may be varied in dependence on the actual application.

What is claimed is:

1. An inductive sensor for controlling timing of an electronic ignition system having an induction cool for combustion engines, comprising:

a sensor coil adjacent the motor flywheel, arranged for a magnetic field to be induced by a magnet on the flywheel, rotating with respect to said sensor coil, wherein said magnet creates a ramplike voltage in said sensor coil and a thin sheet, which are both separate from said induction coil and, said thin sheet being made from a magnetic material arranged to influence the magnetic field such that the timing for achieving a predetermined voltage in said sensor coil is adjusted.

2. A sensor according to claim 1, wherein said thin sheet is mounted adjusted said coil and extends from said coil into the magnet field.

3. A sensor according to claim 2, wherein said thin sheet extends perpendicularly to a longitudinal axis of said sensor coil.

4. A sensor according to claim 2, wherein said thin sheet forms an angle to longitudinal axis of said sensor coil.

5. A sensor according to claim 1, wherein said thin sheet is mounted adjacent said magnet and rotates together with said magnet.

* * * * *